US011603737B2

(12) United States Patent
Quero et al.

(10) Patent No.: US 11,603,737 B2
(45) Date of Patent: Mar. 14, 2023

(54) PUMP DOWN INTERVENTION TOOL AND ASSEMBLY

(71) Applicant: Halliburton Energy Services, Inc., Houston, TX (US)

(72) Inventors: Philippe Quero, Houston, TX (US); Eric Bevins, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 112 days.

(21) Appl. No.: 16/753,462

(22) PCT Filed: Jun. 4, 2019

(86) PCT No.: PCT/US2019/035298

§ 371 (c)(1),
(2) Date: Apr. 3, 2020

(87) PCT Pub. No.: WO2020/246959

PCT Pub. Date: Dec. 10, 2020

(65) Prior Publication Data

US 2021/0404291 A1 Dec. 30, 2021

(51) Int. Cl.
*E21B 34/10* (2006.01)
*E21B 23/02* (2006.01)
(Continued)

(52) U.S. Cl.
CPC ..... *E21B 34/10* (2013.01); *E21B 23/02* (2013.01); *E21B 23/08* (2013.01); *E21B 28/00* (2013.01); *E21B 31/005* (2013.01); *E21B 33/068* (2013.01)

(58) Field of Classification Search
CPC ..... E21B 34/10; E21B 23/02; E21B 23/08; E21B 28/00; E21B 31/005; E21B 33/068
See application file for complete search history.

(56) References Cited

U.S. PATENT DOCUMENTS 4,178,992 A * 12/1979 Regan ..... E21B 23/02 166/117.6
7,472,753 B2 1/2009 Mondelli et al.
(Continued)

FOREIGN PATENT DOCUMENTS

| | | | |
|---|---|---|---|
| EP | 0377255 | A1 | 7/1990 |
| WO | 2012045165 | A1 | 4/2012 |
| WO | 2018075719 | A1 | 4/2018 |

OTHER PUBLICATIONS

International Application No. PCT/US2019/035298, "International Search Report and Written Opinion", dated Mar. 4, 2020, 13 pages.
(Continued)

*Primary Examiner* — Dany E Akakpo
(74) *Attorney, Agent, or Firm* — Kilpatrick Townsend & Stockton LLP

(57) ABSTRACT

A pump down intervention tool may be pumped downhole through a work string after an installation of the work string. The pump down intervention tool may include a downhole tool that includes but is not limited to an agitator tool, including but not limited to a fluidic pulsation device, or a check valve. The pump down intervention tool may be pumped downhole in the work string, for example but not limited to in a coiled tubing or jointed pipes. The pump down intervention tool may be landed at a desired location along a length of the work string. The pump down intervention tool can allow for the addition of a downhole tool after the work string's initial deployment, providing a desired functionality downhole at time after the initial deployment of the work string downhole.

16 Claims, 7 Drawing Sheets

(51) Int. Cl.

| | |
|---|---|
| ***E21B 23/08*** | (2006.01) |
| ***E21B 28/00*** | (2006.01) |
| ***E21B 31/00*** | (2006.01) |
| ***E21B 33/068*** | (2006.01) |

(56) References Cited

U.S. PATENT DOCUMENTS

| | | | | |
|---|---|---|---|---|
| 7,814,982 | B2 | 10/2010 | Moyes | |
| 9,637,991 | B2 | 5/2017 | Eddison et al. | |
| 2006/0237186 | A1* | 10/2006 | Mondelli | E21B 21/10 166/70 |
| 2010/0084145 | A1 | 4/2010 | Giem et al. | |
| 2013/0327532 | A1* | 12/2013 | Ring | E21B 47/09 166/335 |
| 2014/0102804 | A1 | 4/2014 | Cote | |
| 2016/0108710 | A1* | 4/2016 | Hightower | E21B 43/121 166/372 |
| 2017/0175488 | A1 | 6/2017 | Lisowski et al. | |

OTHER PUBLICATIONS

EP Application No. EP19932100.1, "Extended European Search Report", dated Dec. 2, 2022, 8 pages.

* cited by examiner

PUMP DOWN INTERVENTION TOOL AND ASSEMBLY

TECHNICAL FIELD OF THE INVENTION

The present invention relates generally to tools for a work string and, more particularly (although not necessarily exclusively), to intervention tools that may be pumped downhole within a work string after the work string has been deployed downhole.

BACKGROUND

A well system may include a work string deployed downhole within a wellbore. The work string may include various tools, for example but not limited to agitator tools for applying a vibration or other agitating motion to the work string, check valves that may act as a pressure barrier, and tools for pulsating a fluid pumped from a surface of the wellbore. These tools may positioned in a bottom hole assembly ("BHA") of the work string or elsewhere along the work string. The inclusion of these tools on the BHA can increase the length of the BHA and can increase the cost of the BHA. In some well systems, the need for a tool, including but not limited to an agitator tool, check valve, or fluid pulsation tool may not be apparent during the planning of the well system and the work string may not include a certain tool when it is originally designed and deployed downhole. Thereafter, during the life of the well it may be desirable to have such a tool on the BHA or elsewhere along the work string. In some instances, a work string may include a tool when it is originally positioned downhole but the tool may become inoperable during the lifetime of the well. It may be desirable to provide a tool on the working string after the work string has initially been deployed downhole without having to remove the work string from the wellbore.

SUMMARY

Certain aspects and embodiments of the present invention are directed to an intervention tool that may be added to a work string after the work string has been positioned downhole. The intervention tool may be sized and shaped to be pumped downhole from the surface of a wellbore downhole. A pump down intervention tool according to aspects of the present disclosure may be referred to herein as a "dart." The dart may be pumped downhole via a fluid pumped into the work string in which the dart is launched. In some aspects, the dart may be pumped into a wellbore via a launching assembly. In some aspects, the launching assembly may be coupled to a coiled tubing reel for launching a dart downhole via a coiled tubing.

The dart may include a downhole tool, device, or structure for accomplishing a desired task. For example, the dart may include, but is not limited to including, an agitator tool, including but not limited to a fluid pulsation tool, or a check valve. The dart may also include cups, flanges, blades, or other features for aiding in forcing the intervention tool downhole in response to a fluid being pumped down the work string. The cups may provide a surface area that is exposed to a fluid flow for aiding in the downhole propagation of the dart as the fluid is pumped into the well string. In some aspects, the dart may include blades or vanes for inducing rotation.

The dart may engage with a region of a work string downhole, for example by reaching an impasse in the work string where the maximum outer diameter of the dart exceeds the inner diameter of the work string, or by coupling a locking mechanism on the dart with a receiving mechanism on the work string. In some aspects, the dart engages with the BHA. In some aspects, the dart may be pumped downhole to a desired location in the work string at which point pumping may cease and the dart may remain resting at the desired location or in some aspects may be anchored or coupled to the work string at the desired location. Thus, the dart may be pumped downhole to provide a tool downhole that was not originally provided for on the work string or to replace a tool that was provided on the work string but is not functioning properly.

The dart can provide for additional functionality on the working string that was not initially contemplated for the work string. In some instances, the dart may permit a reduced length of the work string, which can reduce costs associated with the well system.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and embodiments of the present disclosure describes a device and an apparatus to enable pumping one or more intervention tools downhole through a tubing string. The intervention tools that may be pumped downhole through a work string (or tubing string) according to various aspects of the present disclosure are hereinafter referred to as "darts". The work string may include coiled tubing or jointed pipes. The dart may be pumped downhole through the coiled tubing or the jointed pipes to a desired depth. The dart can be pumped downhole after the work string's initial deployment such that a preconfigured tool need not be installed on the work string initially; instead, the dart can provide the desired functionality downhole at a later time after the initial deployment of the work string downhole.

The dart may be configured to produce a variety of effects based on the internal configuration of a downhole tool included within the dart. In some aspects, the dart may include a housing, for example a cylindrical housing, with various downhole tools that may be inserted within the housing. In some aspects, various darts may each include different downhole tools that are integral with the dart housing (i.e., not separately removable from the dart housing). The dart may include tools such as check valve or an agitator tool (including but not limited to a fluidic pulsation device), though in some aspects, the dart may include other tools or functions.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "above," "below," "upper," "lower," "left," "right," "downhole," "up-hole," etc. in relation to the illustrative aspects as they are depicted in the figures, the downhole direction being toward the toe of the well. Like the illustrative aspects, the numerals and directional descriptions included in the following should not be used to limit the present disclosure. Furthermore, the following uses the term "or" to denote any combination of options separated by the term "or", including combinations in which only one of the options is utilized and combinations in which more than one (and in some cases, all) of the options are utilized.

Figure 1A:
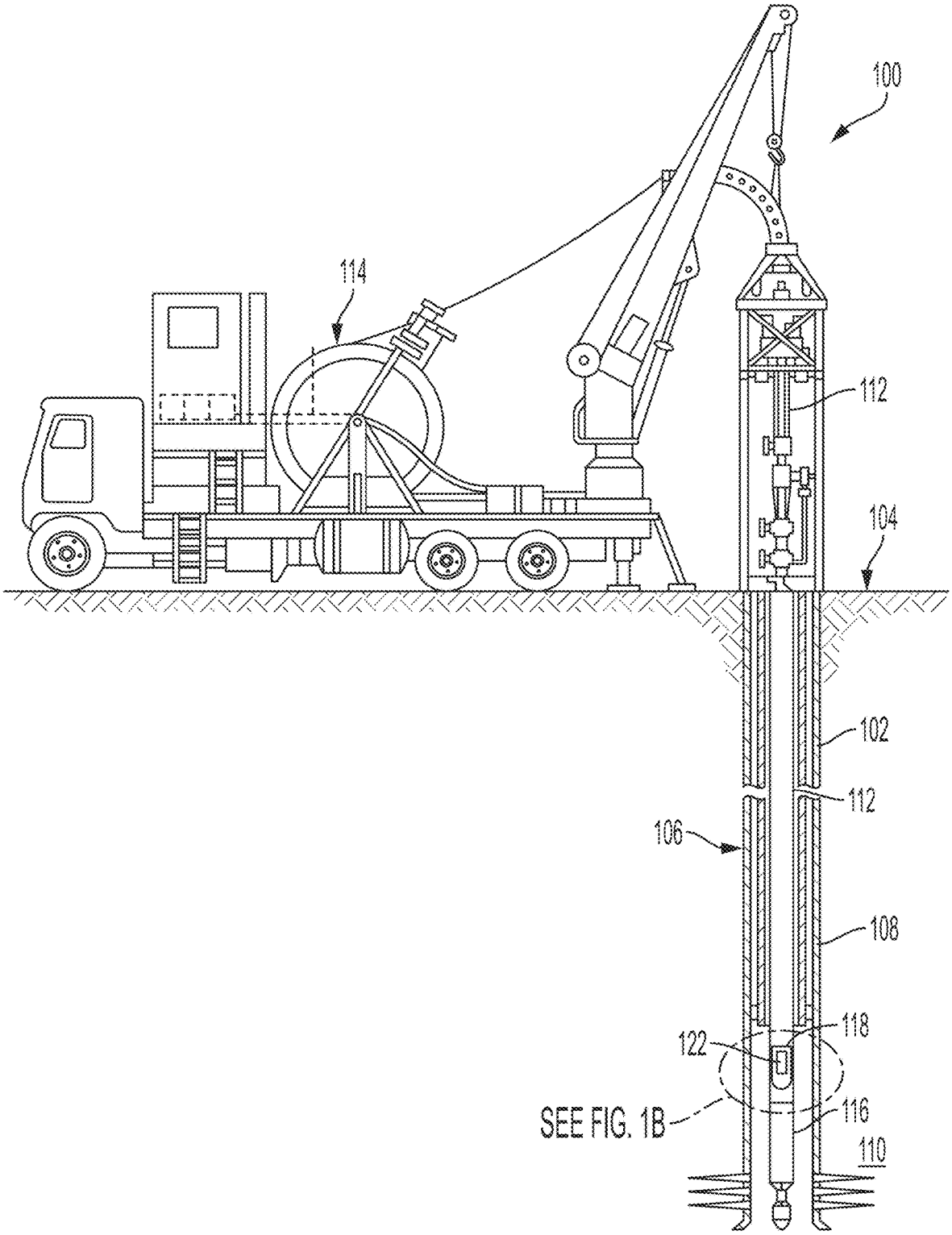
FIG. 1A is a schematic illustration of a well system including a dart that has been launched from the surface downhole into a work string according to an aspect of the present invention.
Figure 1B:
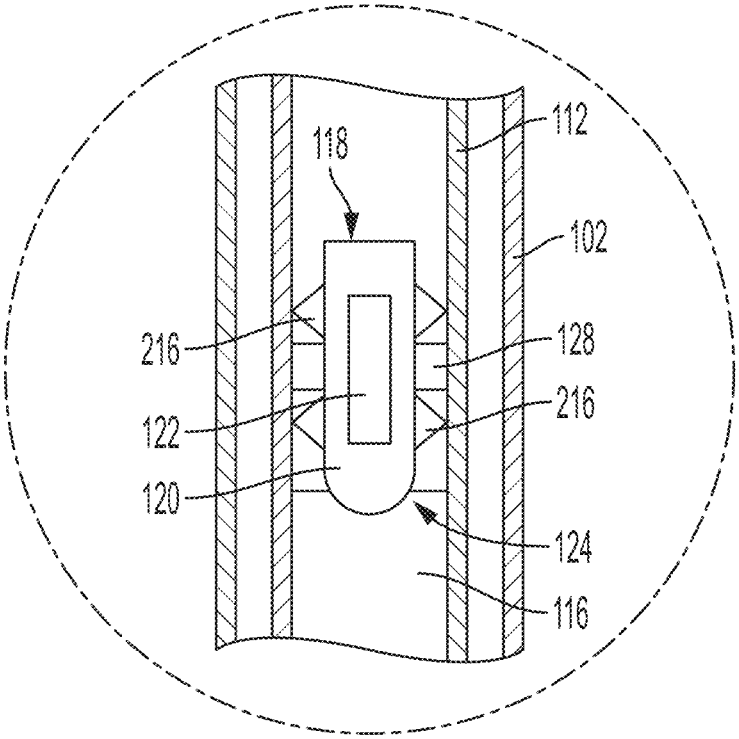
FIG. 1B is an enlarged view of a portion of the schematic illustration of FIG. 1A according to an aspect of the present invention.

FIGS. 1A-1B depict a well system 100 including a bore that is a wellbore 102 extending from a surface 104 through various earth strata. The wellbore 102 has a substantially vertical section 106. In some aspects, the wellbore 102 may also include a substantially horizontal section. Some length of the substantially vertical section 106 may include a casing string 108. The substantially vertical section 106 extends through a hydrocarbon bearing subterranean formation 110.

A tubing string (or work string) 112 extends from the surface 104 within wellbore 102. The tubing string 112 is shown in FIGS. 1A-1B as a coiled tubing extending from a coiled tubing reel 114 at the surface 104 of the wellbore 102. In some aspects, the tubing string 112 may include a series of jointed pipes. A downhole portion of the tubing string 112 is the BHA 116.

FIGS. 1A-1B depict an intervention tool or dart 118 deployed within an inner diameter "ID" of the tubing string 112. The dart 118 is shown landed a particular location on the tubing string 112 but may be landed in other regions of the tubing string 112 in other aspects. In some aspects, the dart 118 may be landed in the BHA 116. The dart 118 may include a tool, for example an interventional tool including but not limited to an agitator tool (including but not limited to a fluidic pulsation device) or a check valve. The dart 118 may include a housing 120 within which a tool 122 (e.g. a downhole tool) may be positioned. The housing 120 may be cylindrical in shape, though in some aspects other shapes may be used. The housing 120 may have a maximum outer diameter that determines a positon along a length of the tubing string 112 at which the dart 118 may be landed.

In some aspects, the tool 122 may be inserted or removed from the housing 120 while in other aspects the tool 122 may be uncoupleable from (including but not limited to integral with) the housing 120. In some aspects, the dart 118 may have a tapered end 124 that may be positionable downhole. The dart 118 may also include an opening or inlet on a first end and an opening or outlet a second end for defining a flow path through the dart 118.

In some aspects, the dart 118 may also include a locking mechanism that is sized and shaped to engage or mate with a receiving feature on the inner surface of the tubing string 112. The locking mechanism may include but is not limited to a locking ring that may engage a profile in the tubing string 112 within which it is deployed. For example, the locking ring may engage with the BHA to secure the dart 118 in place on the BHA. In some aspects the locking ring may allow bespoke engagement of the dart 118 downhole within the tubing string, for example within a receiving sub of the tubing string 112. The locking mechanism may prevent the dart 118 from moving back up-hole or otherwise disengaging with the tubing string 112. The locking mechanism may be positioned at any point along a length of the dart 118.

As shown in FIG. 1B, the dart 118 also includes multiple flanges, blades, or cups 126 that may provide a surface area exposed to a fluid flow when the dart 118 is pumped downhole. The cups 126 may extend around an entire circumference of the housing 120 though in some aspects the cups 126 may only extend partially around the circumference of the housing 120. The cups 126 may comprise a semi-flexible material to accommodate an internal weld flash on the tubing string 112, or a more rigid material allowing a sealing around the weld flash on the tubing string 112.

The dart 118 also include pads 128 on the housing 120 which may allow the dart 118 to move within the tubing string 112 in a downhole direction but prevent movement of the dart 118 in an up-hole direction. In other words, the pads 128 may be mono-directional slips or pads that allow only a single direction of motion of the dart 118. These pads 128 may aid in setting the dart 118 at any depth within the tubing string 112 without using a secondary locking mechanism. In this way the dart 118 may be used to provide a barrier seal above a leak, pinhole, or other damaged point in the tubing string 112 at any depth.

In some aspects, the dart 118 may be coupleable to an additional dart. The dart 118 may include a feature, for example a locking feature that engages with a surface or region of an additional dart when the darts are positioned within the tubing string 112.

In some aspects, the tool 122 of the dart 118 may include a check valve for placement or replacement of a check valve in the tubing string 112. The check valve may be, but is not limited to, a back pressure valve to provide a barrier to pressure. The back pressure valve may permit a fluid or pressure from above to pass through the dart 118 to enable pumping of flow through the tubing string 112 below the position of the dart 118. In some aspects, the check valve may be a flapper cartridge that may provide a one-way flapper valve for allowing a flow or pressure to pass through the check valve from above but sealing against a flow or pressure from below the dart 118.

In some aspects, the tool 122 of the dart 118 may include an agitator tool. The agitator tool may create a fluidic hammer or vibrating effect on the tubing string 112 for extended reach or freeing the stuck tubing string 112. In some aspects, the agitator tool may create downhole pressure pulses for pushing fluids or treatments into the formation or behind the casing, or loosening or dislodging wellbore deposits or debris, or other suitable purposes.

In some aspects, the agitator tool of the tool 122 may include an oscillatory piston with inner and outer ports that may align and misalign to create a build-up and subsequent release of pressure through the inner and outer ports relative to their alignment. The movement between the alignment and misalignment of the inner and outer ports can produce a fluidic hammering effect. In some aspects, the agitator tool of the tool 122 may include a j-slot or fluidic oscillator, for example, a down-jet fluidic oscillator, a fan-jet fluidic oscillator, or a side-jet fluidic oscillator for creating pulses in a fluid flow through the dart 118. The tool 122 including a fluidic oscillator can provide a rapid cycling between positions in response to a continuous fluid flow for altering the alignment of a flow port through the dart 118 for creating pulses in the outflow of the fluid through the dart 118 via the flow port.

The dart 118 may be deployed downhole via a launching apparatus 130 coupled to the coiled tubing plumbing 132, an aspect of which is described further below with reference to FIGS. 5 and 6.

Figure 2:
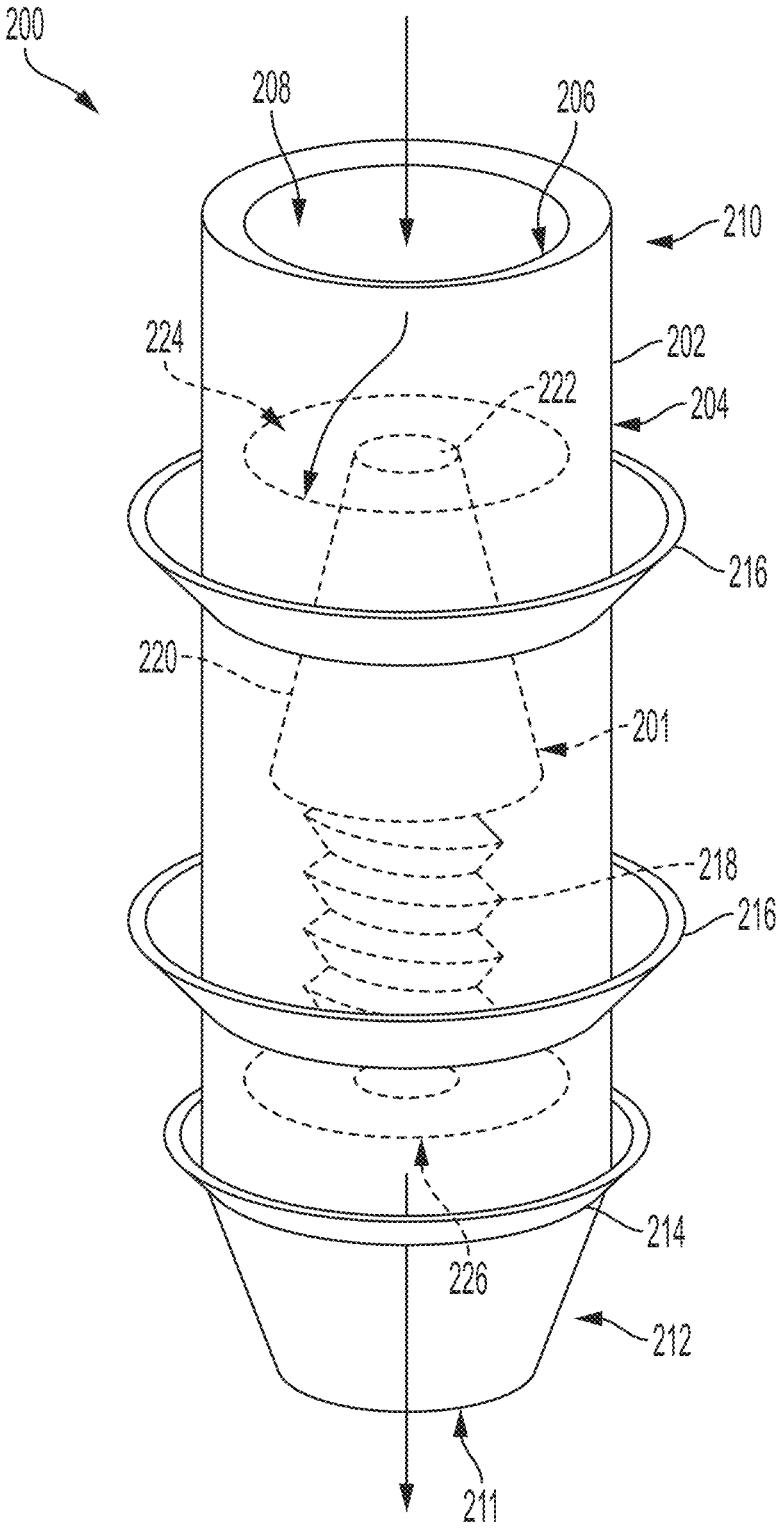
FIG. 2 is an isometric view of a dart including a check valve according to one aspect of the present invention.

FIG. 2 depicts an isometric view of a dart 200 including a check valve 201 according to an aspect of the present disclosure. The dart 200 includes a housing 202 shown as see through to provide visual access to the check valve 201 in the figure. The housing 202 includes an outer surface 204 and an inner surface 206. The inner surface 206 of the dart 200 may define a first opening (or inlet) 208 in a first end 210 of the dart 200. The inner surface 206 may also define a second opening (or outlet) 211 in a second end 212 of the dart 200. The first and second openings 208, 211 may define a flow path through the dart 200 through which a fluid may flow. The second opening 211 may permit fluid to exit the housing 202. The check valve 201 is positioned within the flow path through the dart 200. The second end 212 of the dart 200 may be tapered. The tapered shape of the second end 212 may identify for a user a downhole end of the dart 200 and may provide a smaller outer diameter to aid in allowing the dart 200 to push past an inner diameter restriction within the tubing string it is deployed in.

In some aspects the tapered shaped of the second end 212 may act as a locking mechanism in that it is sized and shaped to engage or mate with a receiving feature on the inner surface of the tubing string within which the dart 200 is deployed. In some aspects, the dart 200 may include a separate locking mechanism such as a locking ring 214 that may engage a profile in the tubing string within which it is deployed. In some aspects the locking ring 214 may allow bespoke engagement of the dart 200 downhole within the tubing string, for example within a receiving sub of the tubing string. The locking mechanism, for example locking ring 214 may prevent the dart 200 from moving back up-hole or otherwise disengaging with the tubing string. The locking mechanism may be positioned proximate the first end 210, the second end 212 or at any point along a length of the dart 200.

The dart 200 also includes multiple flanges, blades, or cups 216 positioned on the outer surface 204. The cups 216 may extend around an entire circumference of the housing 202 as shown in FIG. 2, though in some aspects the cups 216 may only extend partially around the circumference of the housing 202. The cups 216 may comprise a semi-flexible material to accommodate an internal weld flash on a coiled tubing within which the dart 200 is deployed, or a more rigid material allowing a sealing around the weld flash on the coiled tubing.

The check valve 201 of dart 200 may include a spring 218 that is coupled to a piston 220. The piston 220 may be sized and shaped at a sealing end 222 to seal against an inlet 224 of the check valve 201. The piston 220 has an open position in which the piston 220 move downwards and compresses the spring 218 in response to a sufficient pressure from above the piston 220. In the open position, fluid may flow through the first end 210 of the dart 200, through the inlet 224 of the check valve 201 and out an outlet 226 of the check valve and out the second end 212 of the dart 200. In other words, fluid may flow through the flow path in the dart 200 when the piston 220 is in the open position. The piston 220 has a closed position in which the spring 218 extends such that the sealing end 222 of the piston 220 seals against the inlet 224 of the check valve 201 and prevent fluid flow through the inlet 224. The piston 220 may move to the closed position in response to a lack of sufficient pressure from above the piston 220 to compress the spring 218. In the closed position, the piston 220 prevents fluid from flowing through the check valve 201 and thus prevents fluid from flowing through the flow path in the dart 200.

In some aspects, the dart 200 may include a check valve 201 that is a flapper cartridge including for example a one way flapper valve or other similar valve that allows for a flow or a pressure from above the check valve 201 to pass through to below the check valve 201, but sealing or preventing a flow or a pressure from below the check valve 201 from pass through to above the check valve 201.

Figure 3:
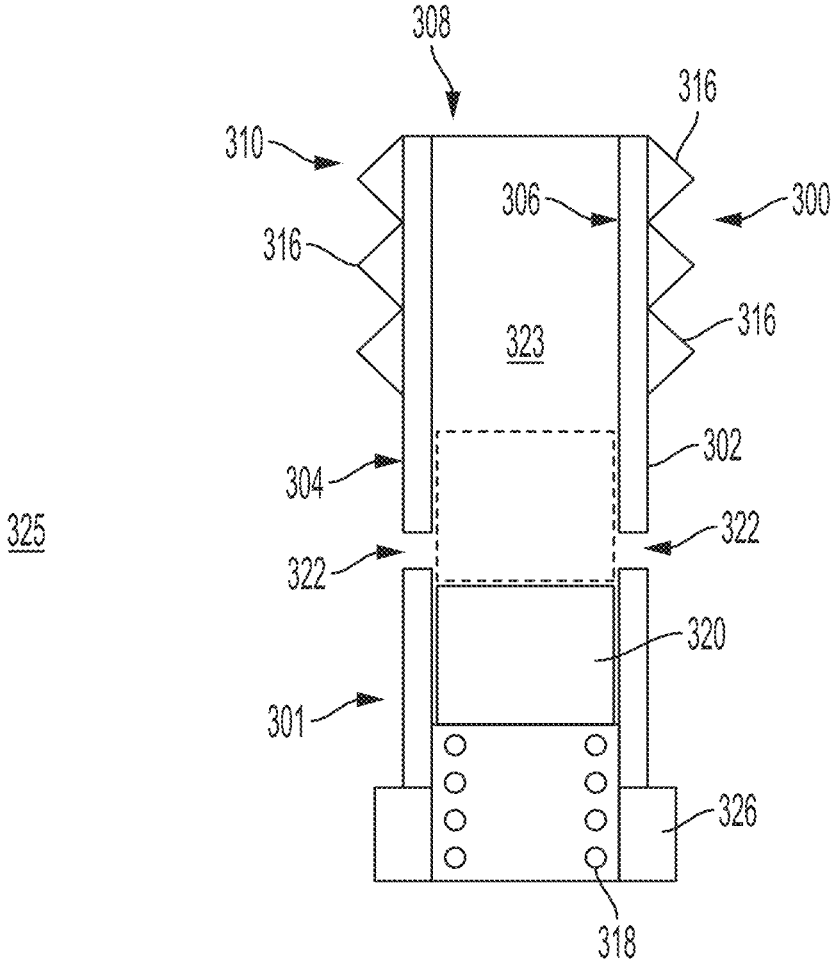
FIG. 3 is a cross-sectional side view of a dart including an agitator tool according to one aspect of the present invention.

FIG. 3 depicts a cross-sectional side view of a dart 300 that includes an agitator tool 301 according to an aspect of the present disclosure. The dart 300 includes a housing 302 having an outer surface 304 and an inner surface 306. The inner surface 306 of the dart 300 may define a first opening (or inlet) 308 in a first end 310 of the dart 300.

The dart 300 also includes multiple flanges, blades, or cups 316 positioned on the outer surface 304. The cups 316 may extend around an entire circumference of the housing 302 as shown in FIG. 3, though in some aspects the cups 316 may only extend partially around the circumference of the housing 302. The cups 316 may comprise a semi-flexible material to accommodate an internal weld flash on a coiled tubing within which the dart 300 is deployed, or a more rigid material allowing a sealing around the weld flash on the coiled tubing.

The agitator tool 301 of dart 300 may include a spring 318 that is coupled to a tube or piston 320. The housing 302 includes ports 322 that provide fluid communication between an inner region 323 of the housing 302 and an outer region 325 of the housing 302. The piston 320 has an open position and a closed position. In the closed position (shown in broken lines in FIG. 3) the piston 320 is positioned within the housing 302 such that the piston 320 blocks the ports 322 of the housing and prevents fluid flow from the inner region 323 of the housing 302 to the outer region 325 of the housing 302 via the ports 322. The pressure above the piston 320 may increase as fluid is pumped into the work string within which the dart 300 is launched when the dart is in the closed position. In response to a sufficient amount of pressure above the piston 320, the piston 320 may move downhole, compressing the spring 318 until the piston 320 is positioned at least partially below the ports 322. The piston 320 is in the open position (as shown in FIG. 3) when the piston 320 is positioned at least partially below the ports 322 such that fluid may flow through the first end 310 of the dart 300 and exit the housing 302 via the ports 322. As the fluid exits the dart 300 via the ports 322, the pressure above the piston 320 may decrease and the spring 318 may force the piston 320 back up-hole to the closed position in which the ports 322 are blocked by the piston 320.

The spring 318 may not compress in response to a pressure above the piston 320 until the dart 300 has bottomed out or engaged with a BHA 326, as shown in FIG. 3. The movement of the piston 320 between the open and closed positions can impart an impact force or a vibrational force, i.e. an agitation motion. The cycling of the piston 320 between the open and the closed position as the pressure builds or bleeds off, can act as a fluidic hammer, can provide a direct impact force, or can provide a vibrational agitating motion, for example for freeing a stuck tubing downhole. In some aspects, the dart 300 may be used for providing downhole pressure pulses via the agitator tool 301 for pushing a fluid or a treatment into the formation, behind a casing, or for loosening or dislodging wellbore deposits or debris. The agitation frequency of the dart 300 can be achieved based on the specific configurations of the housing 302, the piston 320, the spring 318, and the ports 322.

Figure 4:
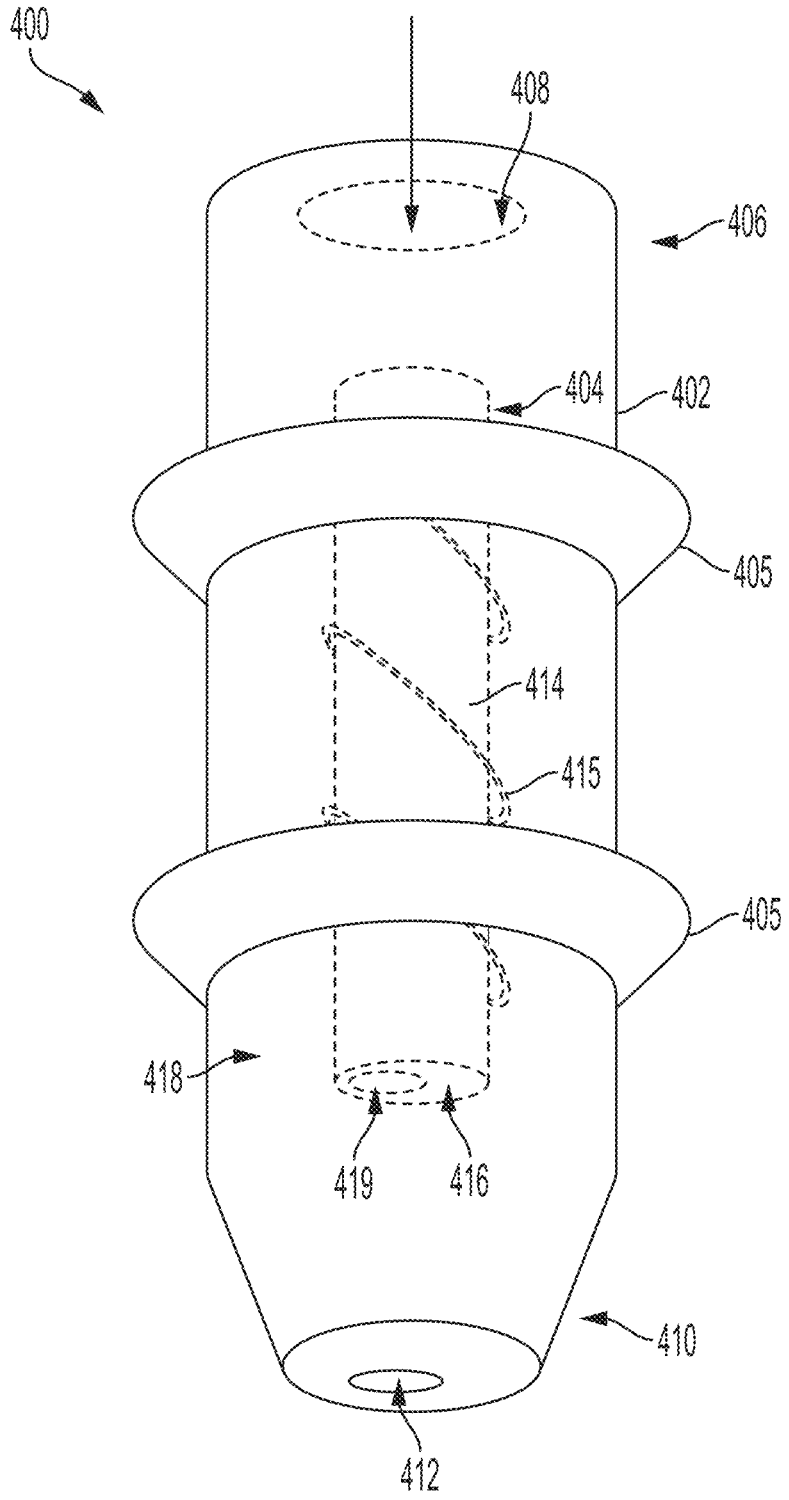
FIG. 4 is an isometric view of dart including an agitator tool according to one aspect of the present invention.

In some aspects, a dart, for example dart 118, may include another aspect of an agitator tool. FIG. 4 depicts an isometric drawing of a dart 400 according to an aspect of the present disclosure. The dart 400 includes a housing 402 that is shown in FIG. 4 as see-through to provide visual access to an agitator tool 404 positioned within the housing 402. The dart 400 also includes cups 405 for aiding in forcing the dart 400 downhole in response to a fluid flow or pressure from above the dart 400. A first end 406 of the dart 400 includes an opening 408 in the housing 402 for allowing a fluid flow to enter an inner region of the dart 400.

A second end 410 of the dart 400, opposite the first end 406, includes an opening (or outlet) 412. The second end 410 of the dart 400 may be a tapered end and may be the end of the dart 400 that is positioned downhole when the dart 400 is inserted into a tubing string (e.g. a coiled tubing or jointed pipes). The second end 410 of the dart 400 may be sized and shaped to engage with a BHA. In some aspects, the dart 400 may include a locking feature or mechanism for engaging the dart 400 in locking engagement with a BHA.

The agitator tool 404 may include a rotatable valve 414, for example but not limited to an impeller, a rotor, a stator, or other similar rotating valve that may spin as fluid is passed through the dart 400. The rotatable valve 414 may rotate relative to the housing 402, for example as a fluid passes between the rotatable valve 414 and the housing 402 the fluid may induce rotation of the rotatable valve 414. For example, as shown in FIG. 4, the rotatable valve 414 may include a plurality of blades 415 positioned about an outer surface of the rotatable valve 414. The impeller blades 415 may cause the rotatable valve 414 to rotate as the fluid passes between a region between an outer surface the rotatable valve 414 and an inner surface of the housing 402. In some aspects, the rotatable valve 414 may include ridges or other mating features on the outer surface of the rotatable valve 414 that are matched by an interfacing profile on the inner surface of the housing 402 for defining the movement of the rotatable valve 414 relative the housing 402. The fluid passing in the region between the outer surface of the rotatable valve 414 and the inner surface of the housing 402 can induce rotation based on pressure build-up in that region. The agitator tool 404 may also include a plate 416 positioned at a lower end 418 of the rotatable valve 414. The plate 416 includes an opening (or port) 419. The opening 419 is sized, shaped, and positioned such that as the rotatable valve 414 spins, the opening 419 in the plate aligns and misaligns with the outlet 412 in the second end 410 of the housing 402 of the dart 400. Thus, a fluid may enter the dart 400 through the opening 408 in the first end 406 of the dart 400, the fluid may flow through the rotatable valve 414 and in doing so may cause the rotation of the rotatable valve 414, the fluid may flow through the opening 419 in the plate 416 and may exit the housing 402 through the outlet 412 in the second end of the housing 402. As the opening 419 in the plate 416 aligns and misaligns with the outlet 412 in the housing 402 as the rotatable valve 414 spins, the outflow of fluid through the port 412 may pulsate. This oscillating flow of fluid through the dart 400 as the opening 419 in the plate 416 aligns and misaligns with the outlet 412 in the housing 402 can act as an agitator for providing a direct impact force or a vibrational agitating motion, for example for freeing a stuck tubing downhole. In some aspects, the dart 400 may be used for providing downhole pressure pulses via the agitator tool 404 for pushing a fluid or a treatment into the formation, behind a casing, or for loosening or dislodging wellbore deposits or debris.

In some aspects, a spring mechanism may be added to the agitator tool 404 to add an element of a physical hammering effect to provide additional intensity to the force provided by the agitating motion of the agitator tool 404.

Darts according to aspects of the present disclosure, for example but not limited to darts 118, 200, 300, and 400, may be launched downhole by inserting a dart directly into the work string flow path. For example, in some aspects, a point in the flow iron may be opened and the dart may be pushed into the flow path by hand. In some aspects, the dart may be launched downhole via a launch assembly. For example, in aspects in which the dart is launched into a coiled tubing, the dart may be launched via a launch assembly. The launch assembly may improve operational efficiency and safety in some aspects. For example, in some aspects a chemical or other substance may be pumped through the coiled tubing (or jointed pipes) and it may be desirable to use a launching assembly (e.g., launching assembly 500 or 600 shown below in FIGS. 5 and 6) to minimize a user's exposure to the chemicals being pumped through the coiled tubing.

Figure 5:
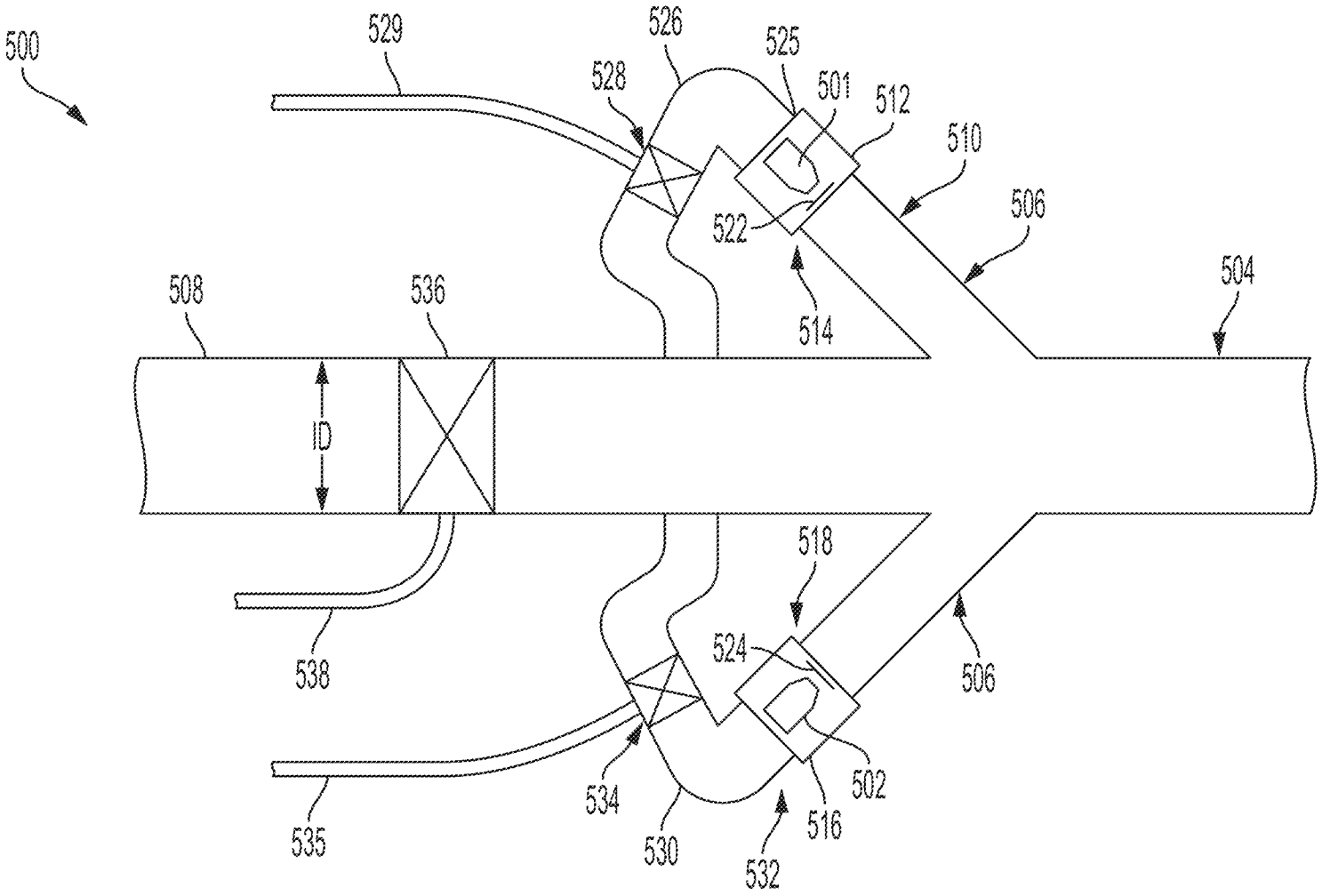
FIG. 5 is a schematic illustration of a dart launching apparatus according to one aspect of the present invention.

FIG. 5 depicts a schematic diagram of a launch assembly 500 for launching darts 501 and 502 into a coiled tubing reel 504 at a surface of a wellbore. The darts 501 and 502 may be any type of dart, including but not limited darts 118, 200, 300, and 400. The launch assembly 500 includes a double wye tubing section ("double wye") 506 that is connected to the coiled tubing reel 504. In some aspects, only a single wye may be used. The double wye 506 is connected to a flow iron 508 of the coiled tubing reel 504. The double wye 506 is connected to the flow iron 508 downstream from a primary valve 536 of the coiled tubing reel 504. The flow iron 508 may have an inner diameter "ID" that is, in some aspects, approximately 2 inches. The double wye 506 may have an inner diameter that is less than the inner diameter of the flow iron 508, for example the arms of the double wye 506 may have in inner diameter in some aspects of approximately 1 inch. In some aspects, the double wye 506 is coupled to the flow iron 508 beyond or past the last hard 90-degree turn of the reel plumbing set-up of the coiled tubing reel 504. The flow iron 508 is connected to a coiled tubing (not shown) at a location further downstream from the double wye 506.

A chamber 512 within which the dart 501 is positioned may be coupled at a first end 514 to a first arm 510 of the double wye 506. A chamber 516 within which the dart 502 is positioned may be coupled at a first end 518 to a second arm 520 of the double wye 506. The darts 501, 502 may be preloaded within the respective chambers 512, 516 in some aspects. In some aspects, the chambers 512, 516 may be loaded or reloaded with a dart, for example darts 501, 502. The chamber 512 containing the dart 501 may include a gate (e.g., a flapper, check valve, or a pin) 522 for retaining the dart 501 within the chamber 512. Similarly, the chamber 516 may include a gate (e.g., a flapper, check valve, or a pin) 524 for retaining the dart 502 within the chamber 516.

A flow line 526 may extend between a second end 525 of the chamber 512 and the flow iron 508. A valve 528 may be positioned within the flow line 526 for controlling a pressure applied to the chamber 512. The gate 522 in the chamber 512 may actuate to an open position in response to the valve 528 being positioned in an open position. The valve 528 may be actuated into the open position in response to a pressure applied by a line 529. The valve 528 may be controllable using hydraulic, pneumatic, electric, fiber optic, manual, wireless or other control mechanisms. The chamber 512 may be exposed to a pressure from the flow iron 508 in response to the valve 528 being in the open position. The pressure applied to the chamber 512 by the flow iron 508 may actuate the gate 522 into an open position. With the gate 522 in the open position and with the pressure applied to the chamber from the flow iron 508, the dart 501 may be forced from the chamber 512 and into the flow iron 508, which is coupled to the coiled tubing. The dart 501 may thereby enter the coiled tubing and be forced downhole in the coiled tubing via the pumping of fluid through the coiled tubing. In some aspects, the launch assembly 500 may not include the gate 522 or 524.

Another flow line 530 may extend between a second end 532 of the chamber 516 and the flow iron 508. Another valve 534 may be positioned within the flow line 530 for controlling a pressure applied to the chamber 516. The gate 524 in the chamber 516 may actuate to an open position in response to the valve 534 being positioned in an open position. The valve 534 may be actuated into the open position in response to a pressure applied by a line 535. The valve 534 may be controllable using hydraulic, pneumatic, electric, fiber optic, manual, wireless or other control mechanisms. The chamber 516 may be exposed to the pressure from the flow iron 508 in response to the valve 534 being in the open position. The pressure applied to the chamber 516 may actuate the gate 524 into an open or release position. With the gate 524 in the open position and with the pressure applied to the chamber from the flow iron 508, the dart 502 may be forced from the chamber 516 and into the flow iron 508, which is coupled to the coiled tubing. The dart 502 may thereby enter the coiled tubing and be forced downhole in the coiled tubing via the pumping of fluid through the coiled tubing. Thus, the darts 501, 502 may be launched into a coiled tubing via the launch assembly 500, which is connected to the coiled tubing reel downstream of the primary valve of the coiled tubing reel and downstream from the last hard 90-degree turn in the coiled tubing reel set-up.

The darts 501, 502 may be launched in a desired order in response to actuating one of the valves 528, 534 first. In some aspects, the launch assembly 500 may not include the gate 522 or 524. In some aspects in which one or more of the gates 522 or 524 are check valves, the chambers 512, 516 may be reloaded with additional darts by closing the first or second valves 528, 534 so that no pressure flows from the flow iron 508 to the chambers 512, 516. The chambers 512, 516 may be reloaded with a dart via a cap or other access point in the chambers 512, 516.

Figure 6:
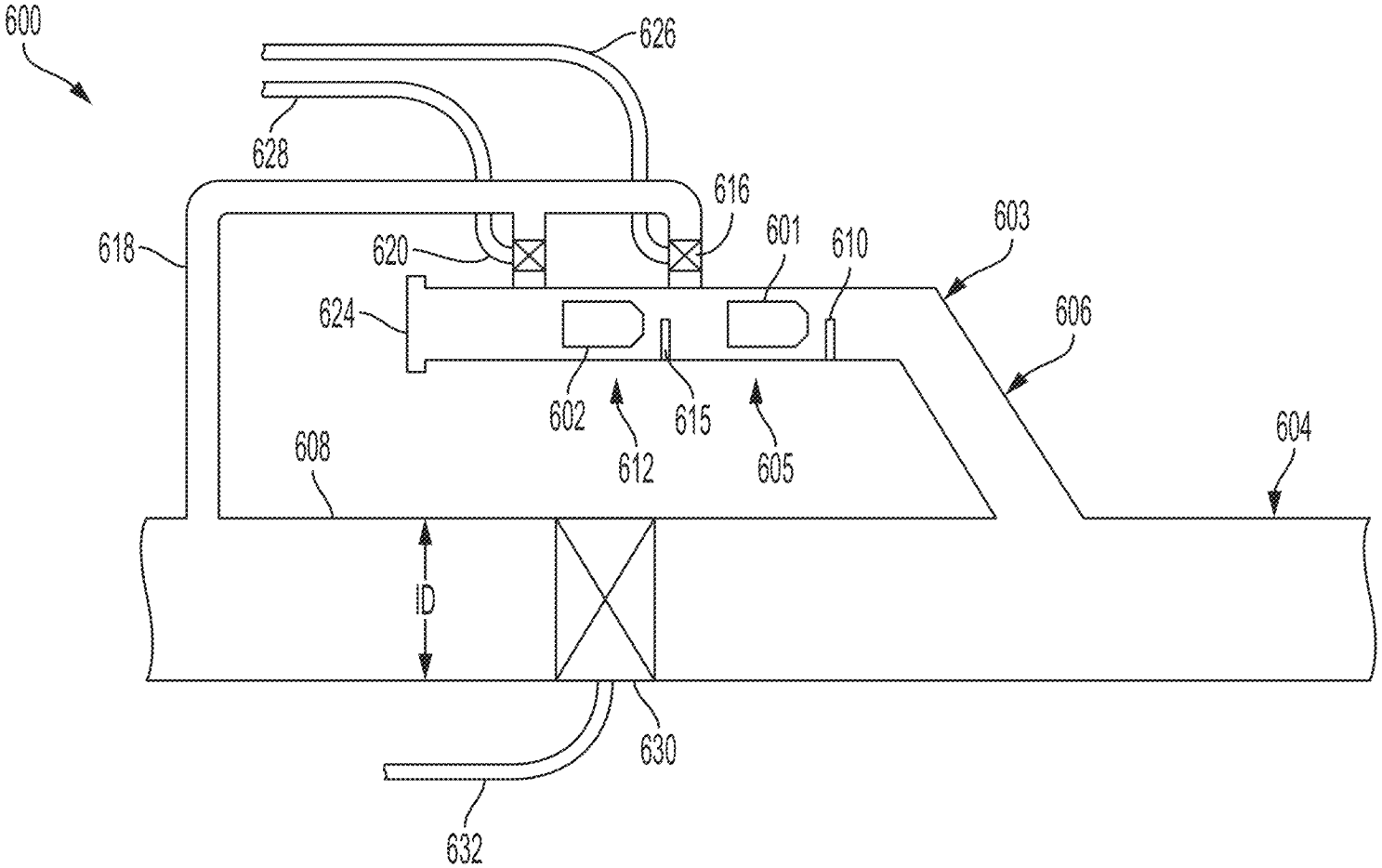
FIG. 6 is a schematic illustration of another dart launching apparatus according to one aspect of the present invention.

FIG. 6 depicts a schematic diagram of a launch assembly 600 for launching darts 601 and 602 into a coiled tubing reel 604 at a surface of a wellbore. The launch assembly 600 includes a single wye tubing section ("single wye") 606 that is connected to the coiled tubing reel 604. The single wye 606 is connected to a flow iron 608 of the coiled tubing reel 604. The single wye 606 is connected to the flow iron 608 downstream from a primary valve 630 of the coiled tubing reel 604. The flow iron 608 may have an inner diameter "ID" that is in some aspects approximately 2 inches. The single wye 606 may have a smaller inner diameter than the flow iron 608, for example, the single wye 606 may in some aspects have an inner diameter of approximately 1 inch. In some aspects, the single wye 606 is coupled to the flow iron 608 beyond or past the last hard 90-degree turn of the reel plumbing set-up of the coiled tubing reel 604. The flow iron 608 is connected to a coiled tubing (not shown) at a location further downstream from the single wye 606.

The launch assembly 600 includes an arm 603 that extends from the flow iron 608. A first chamber 605 is coupled to the arm 603 of the single wye 606. The dart 601 is positioned within the first chamber 605. A gate (e.g., a flapper, check valve, or a pin) 610 is positioned within the first chamber 605 for retaining the dart 601 in the first chamber 605. A second chamber 612 is also coupled to the arm 603 and positioned adjacent the first chamber 605. The dart 602 is positioned within the second chamber 612. A gate (e.g., a flapper, check valve, or a pin) 615 is positioned within the second chamber 612 for retaining the dart 602 in the second chamber 612. Though two chambers 605, 612 are depicted in the launch assembly 600, in some aspects more or fewer chambers may be used.

A first valve 616 may be positioned within a flow line 618 extending between the first chamber 605 and the flow iron 608. A second valve 620 may be positioned within the flow line 618 between the second chamber 612 and the flow iron 608. A cap 624 may be positioned on an end of the single wye 606 to provide access to the first chamber 605 and the second chamber 612 for loading or reloading a dart within the chambers. The darts 601, 602 may be launched sequentially, with dart 601 launched first and the dart 602 being launched second.

The first valve 616 may be actuated into an open position via a line 626. The first valve 616 may be controllable using hydraulic, pneumatic, electric, fiber optic, manual, wireless or other control mechanisms. A pressure from the flow iron 608 may be applied to the first chamber 605 when the first valve 616 is in the open position. The pressure may force the dart 601 out of the first chamber 605, for example, the pressure may also force the gate 610 to move to an open or release position to permit the dart 601 to exit out of the first chamber 605 and enter the flow iron 608.

The second valve 620 may be actuated into an open position via a line 628. The second valve 620 may be controllable using hydraulic, pneumatic, electric, fiber optic, manual, wireless or other control mechanisms. A pressure from the flow iron 608 may be applied to the second chamber 612 when the second valve 620 is in the open position. The pressure may force the dart 614 out of the second chamber 612, for example, the pressure may also force the gate 615 to move to an open or release position as the dart 602 moves out of the first chamber 605 and enters the flow iron 608. The darts 601, 602 may then enter the coiled tubing via the flow iron 608.

In an aspect in which the gates 610, 615 are a check valve, the chambers 605, 612 may be reloaded with additional darts by closing the first and second valves 616, 620 so that no pressure flows from the flow iron 608 to the first and second chambers 605, 612 when the cap 624 is opened.

In some aspects, a launching assembly may utilize a push rod system to push a dart into the tubing string. In some aspects, a launching assembly may use a separately affixed pneumatic line to force a dart into the tubing string. In addition, in some aspects the launching assembly may be used to launch standard darts or balls that are not described herein.

As used below, any reference to a series of examples is to be understood as a reference to each of those examples disjunctively (e.g., "Examples 1-4" is to be understood as "Examples 1, 2, 3, or 4").

Example 1 is a pump down intervention tool comprising: a housing including a first end and a second end, the housing including an outer surface and an inner surface, wherein the inner surface defines a flow path extending from the first end to the second end of the housing; a downhole tool positioned within the flow path of the housing; and a plurality of cups coupled to the outer surface of the housing and each of the cups of the plurality of cups extending at least partially around a circumference of the outer surface of the housing for providing a surface area exposed to a flow of a pumped fluid for aiding in downhole propagation of the pump down intervention tool.

Example 2 is the pump down intervention tool of example 1, further comprising a locking feature for engaging a profile of a work string for securing the pump down intervention tool to a work string while the work string is positioned downhole.

Example 3 is the pump down intervention tool of example 1, wherein the outer surface of the housing defines a maximum outer diameter that is greater than an inner diameter of a tool string positioned downhole for landing the pump down intervention tool on a work string downhole.

Example 4 is the pump down intervention tool of examples 1-3, wherein the downhole tool further comprises a check valve.

Example 5 is the pump down intervention tool of example 4, wherein the check valve is a back pressure valve including a sealing piston coupled to a spring, and wherein the sealing piston may be positioned in an open position in which fluid may flow through the flow path and may exit the housing via an outlet in the second end of the housing, and wherein the check valve may be positioned in a closed position in which fluid is preventing from flowing through the flow path and exiting the outlet in the second end of the housing.

Example 6 is the pump down intervention tool of examples 1-3, wherein the downhole tool further comprises an agitator tool.

Example 7 is the pump down intervention tool of example 6, wherein the housing include a port and wherein the agitator tool further comprises: a spring, and a piston coupled to the spring, wherein the piston is positionable in an open position in which the piston is positioned below the port in the housing for allowing a fluid flow to exit the housing through the port, and wherein the piston is positionable in an closed position in which the piston is aligned with the port for preventing the fluid flow to exit the housing through the port, wherein the piston is positionable repeatedly between the open position and the closed position for providing an agitating force.

Example 8 is the pump down intervention tool of example 6, wherein the housing include a port and wherein the agitator tool further comprises a rotatable valve including a plate defining an opening, wherein the rotatable valve is positionable in an aligned position wherein the opening is aligned with an outlet at the second end of the housing for permitting fluid to exit the housing via the outlet, wherein the rotatable valve is positionable in a misaligned position wherein the opening is misaligned with the outlet at the second end of the housing for preventing fluid to exit the housing via the outlet, and wherein the rotatable valve is moveable between the aligned position and the misaligned position by rotating in response to a fluid entering the first end of the housing.

Example 9 is the pump down intervention tool of example 1-3, wherein the downhole tool further comprises a fluidic pulsating device.

Example 11 is the pump down intervention tool of example 9, wherein the fluidic pulsating device includes a fluidic oscillator for oscillating a fluid flow through the flow path and an outlet in the second end of the housing.

Example 12 is a pump down assembly comprising: a pump down intervention tool; and a launch assembly for launching the pump down intervention tool downhole via a coiled tubing, the launch assembly comprising: a wye tubing section coupled to a pipe of a coiled tubing plumbing positionable at a surface of a wellbore, and a chamber coupled to the wye tubing section for retaining the pump down intervention tool.

Example 13 is the pump down intervention assembly of example 12, wherein the launch assembly further comprises: a flow line coupled between the chamber and the pipe of the coiled tubing plumbing, wherein the chamber is positioned between the wye tubing section and the flow line, a valve positioned within the flow line, the valve positionable in an open position for launching the pump down intervention tool and a closed position for retaining the pump down intervention tool within the chamber.

Example 14 is the pump down intervention assembly of example 13, wherein the launch assembly further comprises: a retainer mechanism positioned between the chamber and the wye tubing section, the retainer mechanism having a retaining position for permitting loading of the chamber with the pump down intervention tool and a release position for releasing the pump down intervention tool from the chamber in response to an actuation of the valve from the closed position to the open position.

Example 15 is the pump down intervention assembly of example 13, further comprising a second wye tubing section coupled to the pipe of the coiled tubing plumbing at a surface of a wellbore, and a second chamber coupled to the second wye tubing section for retaining a second pump down intervention tool.

Example 16 is the pump down intervention assembly of example 12, wherein the launch assembly further comprises: a valve positioned within a first region of the chamber for retaining the pump down intervention tool in the first region of the chamber when the valve is in a closed position; a flow line coupled between the pipe of the coiled tubing plumbing and the first region of the chamber, a second valve positioned within the flow line having an open position for applying a pressure to first region of the chamber for launching the pump down intervention tool from the first region of the chamber.

Example 17 is the pump down intervention assembly of example 16, wherein the chamber includes a removable end cap for providing access to the chamber.

Example 18 is the pump down intervention assembly of example 16, further comprising: a second valve positioned within a second region of the chamber for retaining a second pump downhole intervention tool in the second region of the chamber when the second valve is in a closed position; a second flow line coupled between the pipe of the coiled tubing plumbing and the second region of the chamber, a third valve positioned within the second flow line having an open position for applying a pressure to the second region of the chamber for launching the second pump downhole intervention tool from the second region of the chamber.

Example 19 is the pump down intervention assembly of example 12, wherein the wye tubing section is coupled to the pipe of the coiled tubing plumbing downstream from a primary valve of the pipe of the coiled tubing plumbing and downhole from a last 90 bend of the coiled tubing plumbing.

Example 20 is the pump down intervention assembly of example 19, wherein the pump down intervention tool further comprises: a cylindrical housing including an outer surface and an inner surface, wherein the inner surface defines a flow path extending from a first end to a second end of the cylindrical housing; a downhole tool positioned within the flow path of the cylindrical housing; and a plurality of cups coupled to the outer surface of the cylindrical housing and each of the cups of the plurality of cups extending at least partially around a circumference of the outer surface of the cylindrical housing for providing a surface area exposed to a flow of a pumped fluid for aiding in downhole propagation of the pump down intervention assembly.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A pump down intervention tool comprising:

a housing including a first end and a second end, the housing including an outer surface and an inner surface, wherein the inner surface defines a flow path extending from the first end to the second end of the housing through which a pumped fluid is flowable during downhole propagation of the pump down intervention tool;

a downhole tool positioned within the flow path of the housing;

a plurality of cups coupled to the outer surface of the housing and each of the cups of the plurality of cups extending at least partially around a circumference of the outer surface of the housing for providing a surface area exposed to a flow of the pumped fluid for aiding in downhole propagation of the pump down intervention tool;

a locking feature for engaging a profile of a work string for securing the pump down intervention tool to a work string while the work string is positioned downhole; and a check valve comprising a back pressure valve including a sealing piston coupled to a spring, and wherein the sealing piston may be positioned in an open position in which fluid may flow through the flow path and may exit the housing via an outlet in the second end of the housing, and wherein the check valve may be positioned in a closed position in which fluid is preventing from flowing through the flow path and exiting the outlet in the second end of the housing.

2. The pump down intervention tool of claim 1, wherein the outer surface of the housing defines a maximum outer diameter that is greater than an inner diameter of a tool string positioned downhole for landing the pump down intervention tool on the work string downhole.

3. A pump down assembly comprising:

a pump down intervention tool; and a launch assembly for launching the pump down intervention tool downhole via a coiled tubing, the launch assembly comprising:

a wye tubing section coupled to a pipe of a coiled tubing plumbing positionable at a surface of a wellbore;

a chamber coupled to the wye tubing section for retaining the pump down intervention tool;

a valve positioned within a first region of the chamber for retaining the pump down intervention tool in the first region of the chamber when the valve is in a closed position;

a flow line coupled between the pipe of the coiled tubing plumbing and the first region of the chamber; and a second valve positioned within the flow line having an open position for applying a pressure to first region of the chamber for launching the pump down intervention tool from the first region of the chamber.

4. The pump down intervention assembly of claim 3, wherein the launch assembly further comprises:

a flow line coupled between the chamber and the pipe of the coiled tubing plumbing, wherein the chamber is positioned between the wye tubing section and the flow line, and wherein the valve is positioned within the flow line, the valve positionable in an open position for launching the pump down intervention tool and a closed position for retaining the pump down intervention tool within the chamber.

5. The pump down intervention assembly of claim 4, wherein the launch assembly further comprises:

a retainer mechanism positioned between the chamber and the wye tubing section, the retainer mechanism having a retaining position for permitting loading of the chamber with the pump down intervention tool and a release position for releasing the pump down intervention tool from the chamber in response to an actuation of the valve from the closed position to the open position.

6. The pump down intervention assembly of claim 4, further comprising:

a second wye tubing section coupled to the pipe of the coiled tubing plumbing at a surface of a wellbore; and a second chamber coupled to the second wye tubing section for retaining a second pump down intervention tool.

7. The pump down intervention assembly of claim 3, wherein the chamber includes a removable end cap for providing access to the chamber.

8. The pump down intervention assembly of claim 3, further comprising:

a second valve positioned within a second region of the chamber for retaining a second pump downhole intervention tool in the second region of the chamber when the second valve is in a closed position;

a second flow line coupled between the pipe of the coiled tubing plumbing and the second region of the chamber;

a third valve positioned within the second flow line having an open position for applying a pressure to the second region of the chamber for launching the second pump downhole intervention tool from the second region of the chamber.

9. The pump down intervention assembly of claim 3, wherein the wye tubing section is coupled to the pipe of the coiled tubing plumbing downstream from a primary valve of the pipe of the coiled tubing plumbing and downhole from a last 90 bend of the coiled tubing plumbing.

10. The pump down intervention assembly of claim 9, wherein the pump down intervention tool further comprises:

a cylindrical housing including an outer surface and an inner surface, wherein the inner surface defines a flow path extending from a first end to a second end of the cylindrical housing through which a pumped fluid is flowable during downhole propagation of the pump down intervention tool;

a downhole tool positioned within the flow path of the cylindrical housing; and a plurality of cups coupled to the outer surface of the cylindrical housing and each of the cups of the plurality of cups extending at least partially around a circumference of the outer surface of the cylindrical housing for providing a surface area exposed to a flow of the pumped fluid for aiding in downhole propagation of the pump down intervention assembly.

11. The pump down intervention assembly of claim 10, wherein the pump down intervention tool further comprises a locking feature for engaging a profile of a work string for securing the pump down intervention tool to a work string while the work string is positioned downhole.

12. The pump down intervention assembly of claim 10, wherein the outer surface of the housing of the pump down intervention tool defines a maximum outer diameter that is greater than an inner diameter of a tool string positioned downhole for landing the pump down intervention tool on a work string downhole.

13. A pump down intervention tool comprising:

a housing including a port, and a first end, and a second end, the housing including an outer surface and an inner surface, wherein the inner surface defines a flow path extending from the first end to the second end of the housing through which a pumped fluid is flowable during downhole propagation of the pump down intervention tool;

a downhole tool positioned within the flow path of the housing;

a plurality of cups coupled to the outer surface of the housing and each of the cups of the plurality of cups extending at least partially around a circumference of the outer surface of the housing for providing a surface area exposed to a flow of the pumped fluid for aiding in downhole propagation of the pump down intervention tool;

a locking feature for engaging a profile of a work string for securing the pump down intervention tool to a work string while the work string is positioned downhole; and an agitator tool comprises a rotatable valve including a plate defining an opening, wherein the rotatable valve is positionable in an aligned position wherein the opening is aligned with an outlet at the second end of the housing for permitting fluid to exit the housing via the outlet, wherein the rotatable valve is positionable in a misaligned position wherein the opening is misaligned with the outlet at the second end of the housing for preventing fluid to exit the housing via the outlet, and wherein the rotatable valve is moveable between the aligned position and the misaligned position by rotating in response to a fluid entering the first end of the housing.

14. The pump down intervention tool of claim 13, wherein the outer surface of the housing defines a maximum outer diameter that is greater than an inner diameter of a tool string positioned downhole for landing the pump down intervention tool on the work string downhole.

15. A pump down intervention tool comprising:

a housing including a port, a first end, and a second end, the housing including an outer surface and an inner surface, wherein the inner surface defines a flow path extending from the first end to the second end of the housing through which a pumped fluid is flowable during downhole propagation of the pump down intervention tool;

a downhole tool positioned within the flow path of the housing;

a plurality of cups coupled to the outer surface of the housing and each of the cups of the plurality of cups extending at least partially around a circumference of the outer surface of the housing for providing a surface area exposed to a flow of the pumped fluid for aiding in downhole propagation of the pump down intervention tool;

a locking feature for engaging a profile of a work string for securing the pump down intervention tool to a work string while the work string is positioned downhole; and an agitator tool comprising:

a spring; and an oscillatory piston coupled to the spring, wherein the oscillatory piston is positionable in an open position in which an inner port of the oscillatory piston is positioned below the port in the housing for allowing a fluid flow to exit the housing through the port, and wherein the oscillatory piston is positionable in a closed position in which the inner port of the oscillatory piston is misaligned with the port for preventing the fluid flow to exit the housing through the port, wherein the oscillatory piston is positionable repeatedly between the open position and the closed position for providing an agitating force.

16. The pump down intervention tool of claim 14, wherein the outer surface of the housing defines a maximum outer diameter that is greater than an inner diameter of a tool string positioned downhole for landing the pump down intervention tool on the work string downhole.

* * * * *